United States Patent [19]

Sasao et al.

[11] Patent Number: 4,687,142

[45] Date of Patent: Aug. 18, 1987

[54] FUEL INJECTION VALVE WITH FLUID HONED DISCHARGE PORT AND ASSOCIATED METHODS OF PRODUCTION

[75] Inventors: Isamu Sasao, Kakuda; Yoshiyasu Takaoka, Urawa, both of Japan

[73] Assignee: Honda Giken Kogyo Kabushiki Kaisha, Tokyo; Kabushiki Kaisha Keihinseiki Seisakusko, Kawasaki, both of Japan

[21] Appl. No.: 673,499

[22] Filed: Nov. 20, 1984

[30] Foreign Application Priority Data

Nov. 30, 1983 [JP] Japan ..... 58-224408

[51] Int. Cl.[4] ..... F02M 39/00

[52] U.S. Cl. ..... 239/533.3; 29/818; 29/90 R; 51/317; 239/585

[58] Field of Search ..... 239/585, 590.5, 533.3, 239/DIG. 21; 29/157 C, 557, 90 R, 90 A, 81 B, 81 K; 51/2 R, 317, 318

[56] References Cited

U.S. PATENT DOCUMENTS

| | | | |
|---|---|---|---|
| 2,497,021 | 2/1950 | Sterns | 51/317 |
| 2,583,726 | 1/1952 | Chalom | 51/317 |
| 2,774,193 | 12/1956 | Thatcher et al. | 51/317 |
| 3,039,234 | 6/1962 | Balman | 51/2 R |
| 3,728,821 | 4/1973 | Perry | 51/2 R |
| 4,274,598 | 6/1981 | Wilfert et al. | 239/585 |

*Primary Examiner*—Andres Kashnikow
*Assistant Examiner*—Daniel R. Edelbrock
*Attorney, Agent, or Firm*—Roberts, Spiecens & Cohen

[57] ABSTRACT

A method for producing a smooth finish on the surfaces of a valve seat and a discharge port of a fuel injection valve having a main fuel injection valve body containing an electromagnetic coil, a fixed core, a movable core attracted magnetically towards the fixed core by the coil and a valve rod attached to the movable core and having a valve body for opening and closing a fuel discharge port in a valve seat-forming member attached to the valve body. The fuel discharge port is formed with a smooth surface finish by discharging a honing fluid against the surface. The honing fluid is also discharged against the surface of the valve seat to provide a smooth finish thereon and to provide a rounded corner at the juncture of the seat surface and the fluid discharge port.

6 Claims, 2 Drawing Figures

FUEL INJECTION VALVE WITH FLUID HONED DISCHARGE PORT AND ASSOCIATED METHODS OF PRODUCTION

FIELD OF THE INVENTION

This invention relates to a fuel injection valve which includes a main fuel injection valve body, a movable core attracted magnetically towards a fixed core by an electromagnetic coil disposed within the main fuel injection valve body, a valve rod attached to the movable core and having an end with a valve body formed at the end, and a valve seat-forming member attached to the end of the main body with the valve rod inserted therein.

More specifically, the present invention relates to a fuel injection valve of the above type which is suitable for an electronic fuel injection device.

BACKGROUND

In a fuel injection valve of the above type, particularly one which is used for a spark ignition type internal-combustion engine, the diameter of the fuel discharge port is usually small (for example, less than 1 mm). It is therefore difficult to bore a hole serving as a fuel discharge port in the blank of the valve seat-forming member using a hole-forming member such as a drill, and then surface-finish the hole. In such case, an edge flashing remains and exerts a significant influence upon the fuel flow rate, depending upon the size of the edge flashing and the amount of peeling of the edge flashing due to the flow of the fuel. Moreover, high-level fuel injection control is required for a fuel injection valve of this type, and hence, it is desirable to surface-finish the fuel discharge port to remove such edge flashing and make the surface smooth in order to produce a high performance fuel injection valve.

SUMMARY OF THE INVENTION

An object of the present invention is to provide a fuel injection valve of high performance, which is characterized by utilizing fluid honing as the surface finish for the fuel discharge port.

In accordance with the invention, the fluid discharge port is provided with a fluid honed surface finish and thereby the discharge port can be utilized for a high precision electronic fuel injection device.

The invention also contemplates the method of forming the surface finish of the fluid port by discharging a honing fluid against the surface to achieve the smooth finish.

In a particular embodiment, the valve seat which is joined to the fluid discharge port is also provided with a smooth finish by discharging the honing fluid thereagainst and a rounded corner is formed at the juncture of the seat surface and the fluid discharge port in order to eliminate any potentiality for the formation of a flashing edge thereat.

DETAILED DESCRIPTION

Figure 1:
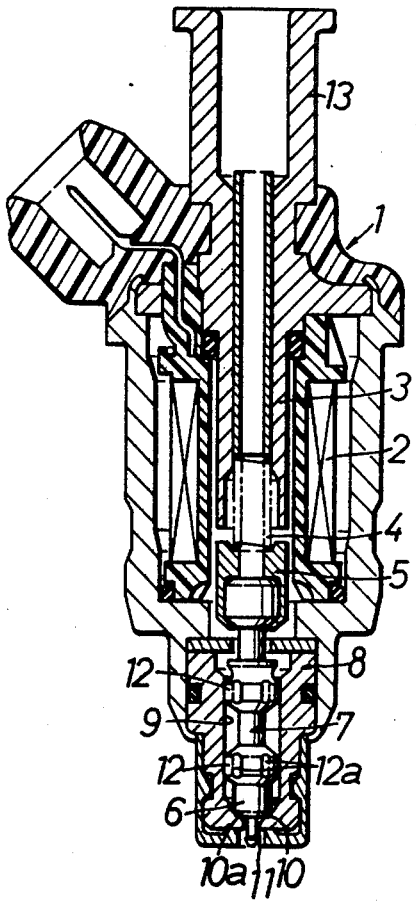
FIG. 1 is a sectional side view of one embodiment of a fuel injection valve in accordance with the present invention.
Figure 2:
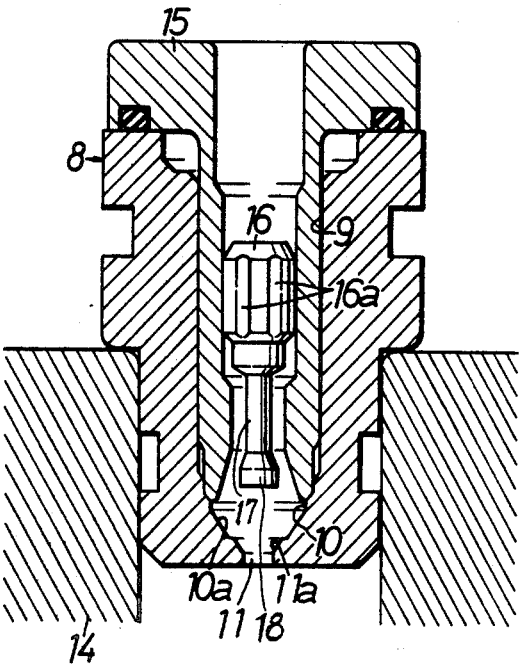
FIG. 2 is a sectional side view of an apparatus for applying a honing finish to the fuel discharge port.

Referring to FIG. 2, therein is seen a main injection valve body 1 and an electromagnetic coil 2 disposed within the main valve body 1.

A fixed core 3 is provided within the electromagnetic coil 2, and a movable core 5 is also provided within the coil 2, in a forward portion thereof in the axial direction. A spring 4 acts on the movable core 5 to urge the core 5 away from fixed core 3. A valve rod 7 having an end with a valve body 6 is connected to the rear end of the movable core 5 and the valve rod 7 extends into a valve seat-forming member 8 attached to the end of the main valve body 1.

The valve seat-forming member 8 is provided with a guide bore 9 that extends in the axial direction, a valve seat 10 formed at the end of the guide bore 9 in continuation therefrom, and a fuel discharge port 11 in continuation from the valve seat 10. The valve rod 7 extends into the guide bore 9 such that a pair of increased diameter portions 12, which are provided with fuel passage grooves **12*a* along the outer peripheries thereof, can slide along the surface of the guide bore 9 whereby opening and closing displacement movements of the valve rod 7 are guided by the guide bore 9. The valve body 6 at the end of the valve rod 7 is normally pressed into contact with the seat surface 10*a* of the valve seat 10 by the spring 4. When electrical voltage is applied to the electromagnetic coil 2, the movable core 5 is magnetically attracted towards the fixed core 3 against the force of the spring 4, and the movement of the valve rod 7 in this instance releases the valve body 6 from the seat surface 10*a*, so that fuel from a socket portion 13 connected to a fuel conduit (not shown) is discharged from the fuel discharge port 11**.

The fuel discharge port 11 is subjected to a fluid honing finish in accordance with the characterizing feature of the present invention, as shown in detail, for example, in FIG. 2. Therein it is seen that the valve seat-forming member 8 is fixed on a jig 14 and a socket member 15 for introducing a honing agent is fitted into the guide bore 9 and covers the surface of the guide bore. A honing agent is then caused to flow through the fuel discharge port 11 from the socket member 15 to effect the honing finish. In this case, a fluid guide member 16 provided with guide grooves **16*a* on its peripheral surface is fitted into the socket member 15, and the end of the socket member 15 is shaped to form a tapered hole that expands forwardly so that the seat surface 10*a* of the valve seat 10 is also subjected to the fluid honing finish simultaneously with the surface of the fuel discharge port 11, and a sharp corner 11*a* between the valve seat 10 and the fuel discharge port 11 is rounded. As a result of this surface finish, the parts of the member 8 including the fuel discharge port 11 which have been subjected to the honing finish are formed to have a surface roughness of about $0.1 \sim 0.8\mu$. As seen in FIG. 2, the guide member 16 is confined within the socket member 15 and has a projecting rod 17 with an expanded tapered portion 18 facing the tapered hole in the socket 15 for guiding the honing agent along an outwardly tapering flow path to obtain the fluid honing finish on the seat surface 10*a* and the fuel discharge port 11**.

As described above, according to the present invention, the fuel discharge port is imparted with a fluid honing finish, so that its surface is smooth whereby a high precision of fuel injection control becomes possible.

What is claimed is:

1. A method for producing a smooth finish on the surfaces of a valve seat and a discharge port of a fuel injection valve which includes:

a main fuel injection valve body;

a valve rod slidable in the main fuel injection body and having an end with a valve body; and a valve seat-forming member attached to said main fuel injection valve body and having a guide bore for receiving the valve rod, a fuel discharge port through which fuel flows for discharge from the injection valve, the fuel discharge port having a bounding surface and being opened and closed by the valve body of the rod and a valve seat between said guide bore and said fuel discharge port, said valve seat having a surface which is contacted by the valve body;

the method comprising forming a smooth finish on said surface of the valve seat and on said surface of the discharge port by fitting a socket member provided with an inlet and an outlet for a honing fluid into the guide bore of the valve seat-forming member with the valve seat-forming member separated from the valve to cover the surface of the guide bore and provide a passage for said honing fluid extending from said inlet to said outlet, fitting a guide member having a peripheral surface provided with guide grooves into said socket member, and thereafter discharging said honing fluid against said surface of the valve seat and said surface of the discharge port from the outlet of the socket member while confining the flow of the honing fluid to pass through said guide grooves and preventing the fluid from acting on the surface of the guide bore.

2. The method as claimed in claim 1, wherein the surface of the fluid discharge port is continuous with the surface of said valve seat and forms a corner therewith, said honing fluid being also discharged against said corner to round said corner.

3. The method as claimed in claim 1, wherein said socket member is shaped to form a gradually expanded tapered hole at its outlet whereas said guide member includes a projecting rod which extends away from said guide grooves and is provided at the end thereof with an expanded tapered portion which extends into said tapered hole of the socket member for guiding the discharged honing fluid toward the valve seat surface along an outwardly tapering flow path.

4. The method as claimed in claim 3, wherein the guide grooves in the peripheral surface of the guide member are formed to extend axially of the guide member for conveying the honing fluid axially through the grooves.

5. A method as claimed in claim 1 wherein the guide member is confined within the socket member causing the honing fluid to flow between the guide member and the socket member onto the surface of the valve seat.

6. A fuel injection valve having smooth surfaces on a valve seat and a fuel discharge port as obtained by the method according to claim 1.

* * * * *

UNITED STATES PATENT AND TRADEMARK OFFICE

CERTIFICATE OF CORRECTION

PATENT NO. : 4,687,142

DATED : Aug. 18, 1987

INVENTOR(S) : Isamu Sasao et al.

It is certified that error appears in the above—identified patent and that said Letters Patent is hereby corrected as shown below:

On the title page

The correct spelling of the second assignee is

-- KABUSHIKI KAISHA KEIHINSEIKI SEISAKUSHO --

Signed and Sealed this

Nineteenth Day of July, 1988

*Attest:*

*Attesting Officer*

DONALD J. QUIGG

*Commissioner of Patents and Trademarks*